US005807061A

United States Patent [19]

Donoghue et al.

[11] Patent Number: 5,807,061

[45] Date of Patent: Sep. 15, 1998

[54] LINKAGE ARRANGEMENT FOR A SKID-STEER LOADER

[75] Inventors: James W. Donoghue, Wichita, Kans.; Richard L. Ehrhardt, Monmouth, Ill.; John M. Moffitt, Wichita, Kans.

[73] Assignee: Case Corporation, Racine, Wis.

[21] Appl. No.: 600,025

[22] Filed: Feb. 12, 1996

[51] Int. Cl.[6] ..... E02F 3/00

[52] U.S. Cl. ..... 414/710; 414/697; 414/918

[58] Field of Search ..... 414/700, 685, 414/697, 708, 710, 918

[56] References Cited

U.S. PATENT DOCUMENTS

| | | | |
|---|---|---|---|
| 3,677,427 | 7/1972 | Allen | 414/697 |
| 3,722,724 | 3/1973 | Blakely | 414/697 X |
| 3,776,403 | 12/1973 | Billings | 414/918 X |
| 3,831,683 | 8/1974 | Ikeda et al. | 172/4.5 |
| 3,913,768 | 10/1975 | Groos et al. | 214/774 |
| 4,288,196 | 9/1981 | Sutton, II | 414/699 |
| 4,295,779 | 10/1981 | Shumaker | 414/685 |
| 4,324,525 | 4/1982 | Lane et al. | 414/699 |
| 4,626,163 | 12/1986 | Link et al. | 414/685 |
| 4,768,917 | 9/1988 | Garman | 414/697 |
| 4,791,549 | 12/1988 | Heiser et al. | 364/167.01 |
| 4,844,685 | 7/1989 | Sagaser | 414/700 |
| 4,889,466 | 12/1989 | Jindai et al. | 414/694 |
| 4,934,463 | 6/1990 | Ishida et al. | 172/4.5 |
| 4,947,705 | 8/1990 | Yates et al. | 414/685 X |
| 4,964,779 | 10/1990 | Sagaser | 414/708 |
| 5,188,502 | 2/1993 | Tonsor et al. | 414/700 |

FOREIGN PATENT DOCUMENTS

| | | | |
|---|---|---|---|
| 214641 | 7/1956 | Australia | 414/697 |

*Primary Examiner*—Donald W. Underwood
*Attorney, Agent, or Firm*—Mayer, Brown & Platt

[57] ABSTRACT

An off-highway loading vehicle having a frame, a cab, and a linkage arrangement for operably attaching a work implement to the frame is disclosed. The loading vehicle includes a pair of spaced apart lift arms having a rear end portion pivotally connected to the frame and a forward end portion pivotally connected to the work implement. A lowermost edge of a forward section of the lift arms angles downwardly from a lowermost edge of a rearward section thereof. Thus, the lift arms avoid contact with the frame when in a lowered position to place the work implement adjacent a front end of the frame. In addition, a lifting device acts between the frame and the lift arms to move the lift arms between the lowered position and a raised position. A tilt mechanism is also provided for pivoting the work implement between a lowered position in which an underside thereof is tilted below a horizontal plane, an intermediate position in which the underside is substantially horizontal, and a raised position in which the underside is tilted above the horizontal plane. The tilt mechanism includes a pair of tilt linkages pivotally connected to the work implement, a pair of extension arms interconnecting the lift arms and the tilt linkages, and a pair of tilt cylinders adapted to move either the tilt linkages or extension arms to thereby tilt the work implement a desired amount. The tilt cylinders are adapted to pivot with respect to the frame in response to raising and lowering of the lift arms.

24 Claims, 5 Drawing Sheets

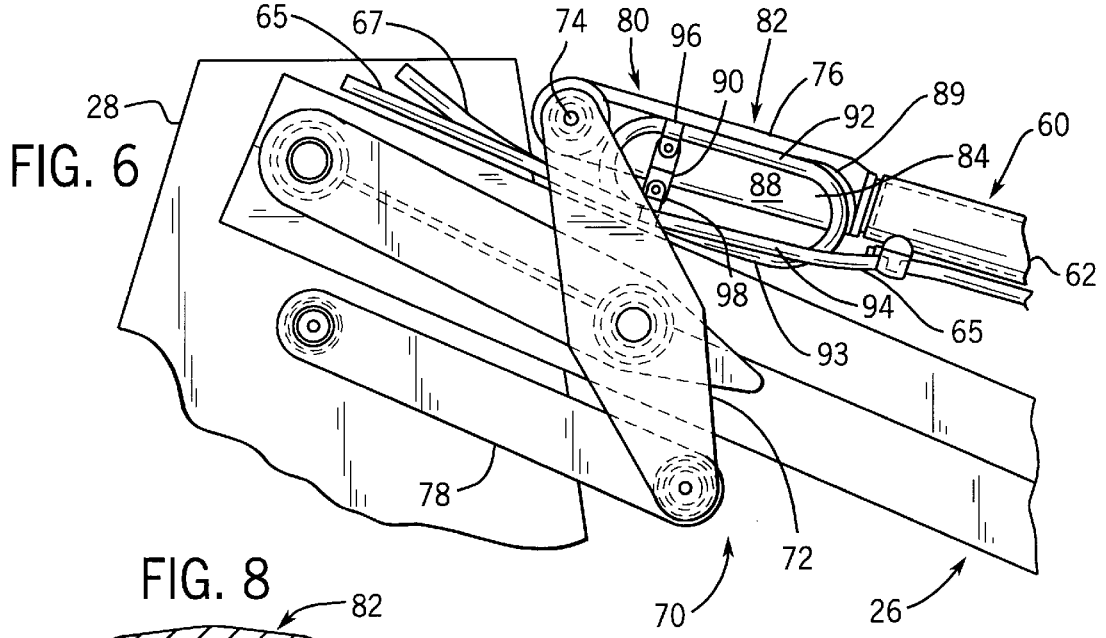
FIG. 6
FIG. 8
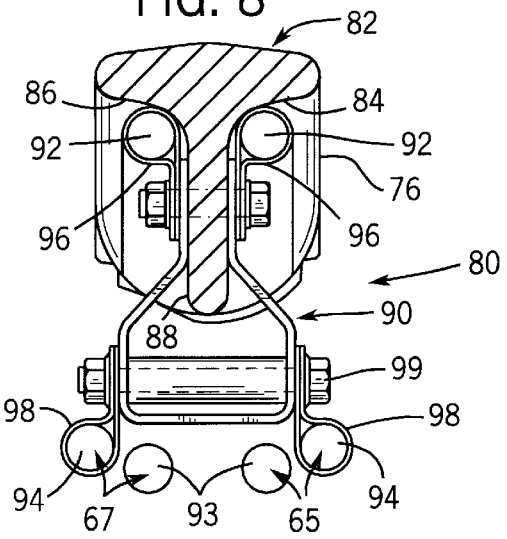
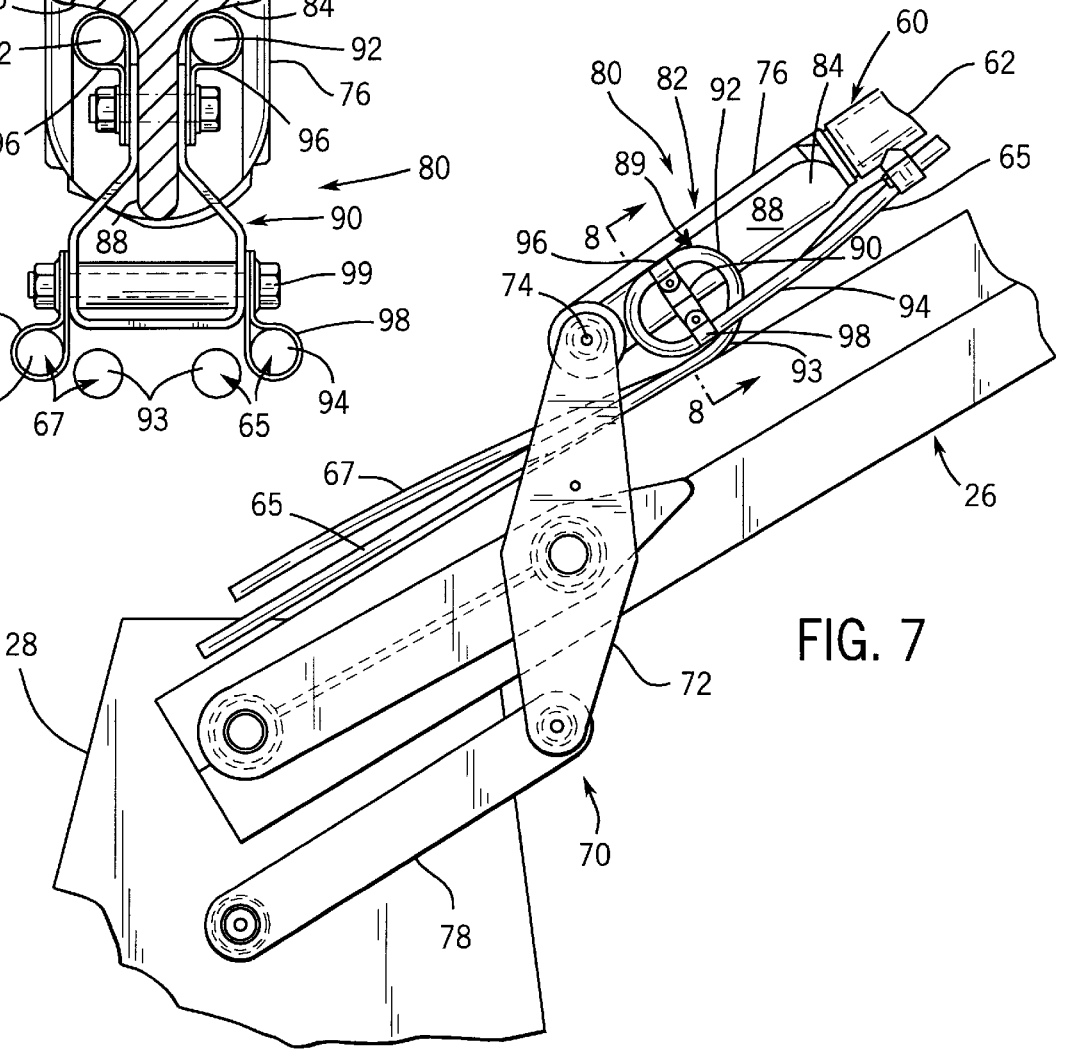
FIG. 7

LINKAGE ARRANGEMENT FOR A SKID-STEER LOADER

FIELD OF THE INVENTION

The present invention relates generally to material handling devices such as skid steer loaders, and more particularly, to a linkage arrangement for operably attaching a work implement to the frame of a loading vehicle.

BACKGROUND OF THE INVENTION

Material handling equipment such as front end loaders and skid steer loaders are commonly known in the construction industry. These loaders typically include an elongated frame or chassis supported by two sets of wheels. In the case of a skid steer loader, the engine compartment is adjacent the rear end of the frame and the operator's compartment is adjacent the front end. The frame includes a pair of stanchions or uprights positioned adjacent the opposite sides of the engine compartment and extending upwardly therefrom. A pair of lift arms are pivotally connected at one end about a common pivot axis on the respective uprights. The arms extend generally forwardly along opposite sides of the frame in close proximity to the operator's compartment and terminate at a work implement at the front of the frame and ahead of the front set of wheels.

Skid steer loaders are relatively small and are normally used in locations where maneuverability and turning space is severely restricted. Consequently, the work implement must be placed as close as possible to the front end of the machine. Because the front wheels typically extend beyond the front end of the machine, the work implement can be placed closest to the front end by positioning the lift arms either inboard or outboard of the wheels.

In the past, this has been accomplished by placing a two-piece or bent lift arm structure inboard of the wheels and over the front end of the machine. The lift arms typically have a relatively long straight section extending from the uprights and a relatively short section extending downwardly from the long section adjacent the front end of the machine where it is connected to the work implement. The bend in the lift arms allows the lift arms to closely follow the contour of the front end of the machine so that the work implement can be positioned close to the front end.

If straight lift arms were utilized, the work implement would have to be placed well in front of the vehicle in order for the arms to avoid interference with the front end of the vehicle. Alternatively, the work implement could be placed in the same close position if straight lift arms were adapted to pass through the gaps between the wheels and the vehicle. However, this would require that the front wheels be placed further outboard and rearward to make room for the lift arms. In such a case, the overall wheel base would decrease and the effective width of the machine would increase. Any increase in width adversely affects the maneuverability and turning radius of the machine.

The work implement is typically configured as a bucket for removing and loading material or a pallet fork attachment for unloading and stacking items resting on a pallet. In either configuration, the work implement is pivoted by a hydraulically operated linkage mechanism that is controlled by the operator seated in the operator's compartment. When the work implement is a bucket, pivotal movement of the bucket between a "rack-back" position and a "dump" position is accomplished through a pair of hydraulic tilt cylinders. The raising and lowering of the lift arms and the bucket relative to the uprights is normally accomplished through a second pair of hydraulic cylinders located between the frame and the lift arms.

When the lift arms are raised by the lift cylinders, the bucket tends to tilt rearwardly with the lift arms and may cause material to spill over the top rear edge thereof. To compensate for this tendency, it is customary to provide a self-leveling linkage arrangement that cooperates with the tilt cylinders for automatically pivoting the bucket forwardly as the lift arms are raised. Typically, the rear end of each tilt cylinder is mounted to a lever which is pivotally attached to the respective lift arms and anchored to the frame of the vehicle by another link. As a result, the mounting of the tilt cylinders is allowed to move with respect to the lift arms as they are raised, thereby allowing the attitude of the bucket to remain substantially constant. One disadvantage of this type of self-leveling linkage arrangement is the difficulty of routing hydraulic lines to the tilt cylinders as they move with the lift arms.

The operational requirements of the work implement vary depending on whether it is configured as a bucket, pallet forks, material handling arms, log and lumber forks, or the like. For example, greater visibility is required between the lift arms when a pallet fork attachment is utilized so that an operator can see the placement of the forks and stacking of the pallets. In contrast, when the bucket is utilized to load material and dump it into a truck, greater visibility is required to the corners of the bucket. To provide adequate visibility regardless of the type of work implement, the lift arms are laterally spaced from each other, and the lift cylinders, tilt cylinders and tilt linkage arrangements are in general vertical alignment with the respective lift arms.

The force requirements also vary depending on the work implement being utilized and the task being performed. For example, a bucket requires the most force in order to break materials loose when digging in hard materials. This "breakout" force is different than that required when the bucket is full of material near the ground and is being tilted from a level position to the "rack-back" position. A pallet fork attachment, on the other hand, requires the greatest force when it is elevated and being tilted rearwardly to lift a loaded pallet. In addition, the maximum force required for the pallet fork attachment may be greater than that required for the bucket. It is therefore desirable to provide generally uniform tilt capability over the entire range of lift heights and work implement tilt positions which can accommodate the maximum force required by any work implement. A recent approach for providing this capability is to attach the tilt cylinder to a linkage or extension projecting rearwardly from a pivotal attachment to the work implement rather than directly attaching the cylinder to the work implement. This provides a moment arm through which the implement force generated from the tilt cylinder increases from full dump to full rack-back position.

Accordingly, it remains desirable to provide a loading vehicle that positions the work implement close to the front end of the vehicle and minimizes the effective width of the vehicle to enhance the maneuverability and turning radius of the machine. It also remains desirable to enhance visibility to the work implement between the lift arms, and to provide a generally uniform tilt capability over the entire range of lift heights and tilt positions which can accommodate the maximum force required by any work implement.

SUMMARY OF THE INVENTION

In view of the above, there is provided an off-highway loading vehicle having a frame, a cab, front and rear tires, and a linkage arrangement for operably attaching a work implement to the frame. In accordance with one aspect of the present invention, the loading vehicle includes a pair of spaced apart lift arms having rear end portions pivotally connected to the frame and forward end portions pivotally connected to the work implement. A lowermost edge of each forward section of the lift arms angles downwardly from a lowermost edge of a rearward section thereof. Thus, the lift arms avoid contact with the frame when in a lowered position to place the work implement adjacent a front end of the frame. In addition, a lifting device acts between the frame and the lift arms to move the lift arms between the lowered position and a raised position. A tilt mechanism is also provided for pivoting the work implement between a lowered position in which an underside thereof is tilted below a horizontal plane, an intermediate position in which the underside is substantially horizontal, and a raised position in which the underside is tilted above the horizontal plane. The tilt mechanism includes a pair of tilt linkages pivotally connected to the work implement and a pair of extension arms interconnecting the lift arms and the tilt linkages. A pair of tilt cylinders are adapted to move either the tilt linkages or the extension arms to thereby tilt the work implement a desired amount. In addition, the tilt cylinders are adapted to pivot with respect to the frame in response to raising and lowering of the lift arms.

According to another aspect of the present invention, the tilt cylinders are pivotable about a pivot point and have a fluid conduit attached thereto. A self-leveling mechanism is provided to move the pivot point in response to raising of the lift arm, thereby maintaining the work implement in a generally level position as the work implement is raised by the lift arm. A conduit control device is also provided to retain the conduit generally taut throughout the range of movement of the tilt cylinder pivot point.

In a preferred embodiment of the invention, the tilt cylinders are conventional double-acting hydraulic cylinders having two hydraulic lines or conduits leading to opposite ends of each cylinder. The tilt cylinders are pivotally connected to respective rear end portions of the tilt linkages, and the tilt linkages, tilt cylinders and extension arms are generally aligned in a vertical plane with the corresponding lift arms. To allow this generally vertical alignment, each tilt linkage has an offset portion displaced from the vertical plane to avoid interference with the lift arms when the work implement is retracted by the tilt mechanism to the raised or "rack-back" position. The rear end portions of the lift arms are also connected to the frame rearwardly of the cab at a level generally as high as a top portion of the cab. In addition, the lift arms are horizontally spaced inboard of the front tires to avoid interference therewith, and they angle downwardly to avoid interference with a forward portion of the frame.

The self-leveling mechanism preferably includes a lever pivotally attached between the ends thereof to each lift arm. An upper end of each lever is pivotally attached to a rear end of a respective tilt cylinder, and a lower end is pivotally attached to a pivot arm which is connected to the frame. Thus, the action of the levers automatically moves the tilt cylinders generally endwise in response to raising of the lift arms to allow the disposition of the work implement to remain generally level or constant. Accordingly, the hydraulic lines or conduits leading to the cylinders must be of sufficient length to allow free endwise movement of the cylinders. When the lift arms are in their lowered positions and the cylinders are in rearward positions, however, the length of the hydraulic lines is somewhat excessive and can cause certain problems. Thus, according to another aspect of the present invention, the conduit control device serves to maintain the hydraulic lines generally taut regardless of the endwise position of the tilt cylinders.

In a preferred embodiment of the conduit control device, a pair of attachment members are provided for securing the conduits to rear end portions of their respective tilt cylinders. Preferably, the end portions of the cylinders are T-shaped to define opposing cavities for receiving the conduits in progressive fashion. The attachment members preferably include a clip attached to each end portion of the cylinders, each clip adapted to hold both conduits in a loop orientation such that a coiling portion of the loop generally overlies a fixed portion of the loop. Thus, the coiling portion of the loop progressively engages the cavities in the tilt cylinder during lowering of the lift arms.

The present invention provides significant advantages over other loading devices. For example, the lift arms bend over the front of the vehicle to position the work implement close to the front end, yet are inboard of the tires so that the width of the vehicle is not affected, thereby enhancing the maneuverability and turning radius of the vehicle. At the same time, the vertical alignment of the respective lift arms, lift cylinders, tilt cylinders, and tilt linkages enhances the visibility to the work implement between the lift arms, while providing a generally uniform tilt capability over the entire range of lift heights and work implement tilt positions which can accommodate the maximum force required by any work implement.

The present invention, together with further objects and advantages, will be best understood by reference to the following detailed description taken in conjunction with the accompanying drawings.

BRIEF DESCRIPTION OF THE DRAWINGS

FIG. 6 is a partial side view of the loading vehicle showing a self-leveling mechanism with a lift arm in a lowered position and a fluid conduit in a coiled position;

FIG. 7 is a partial side view of the loading vehicle showing the self-leveling mechanism and with the lift arm in a raised position and the fluid conduit in an uncoiled position; and FIG. 8 is a cross-sectional view of the fluid cylinder taken along the line 8—8 in FIG. 7 and showing a clip device for mounting the supply line thereto.

DETAILED DESCRIPTION OF THE PREFERRED EMBODIMENT

Figure 1:
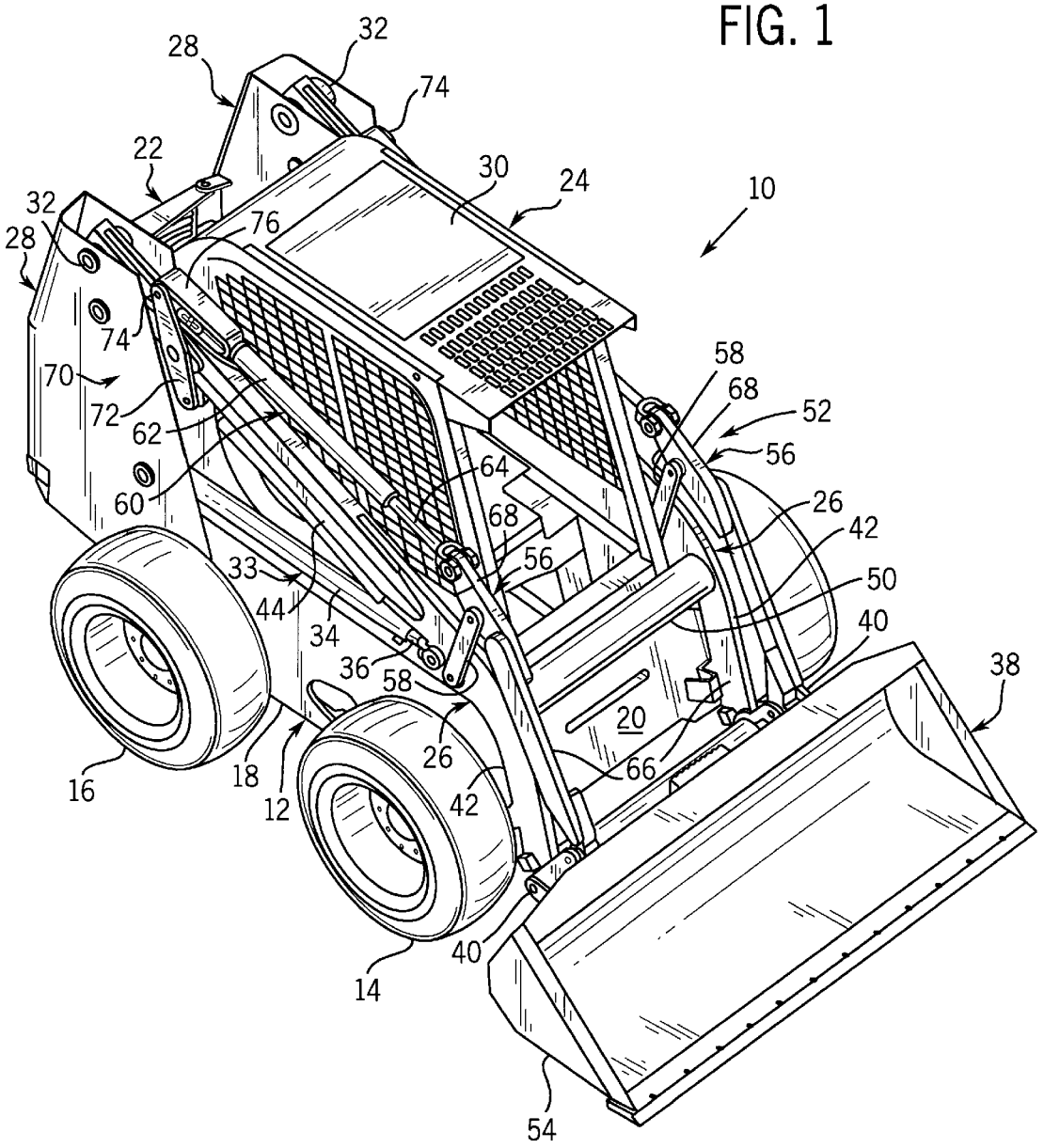
FIG. 1 is a perspective view of a preferred embodiment of the present invention showing a loading vehicle with lowered lift arms and a bucket in a generally horizontal position.

While the present invention is susceptible of embodiments in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Figure 2:
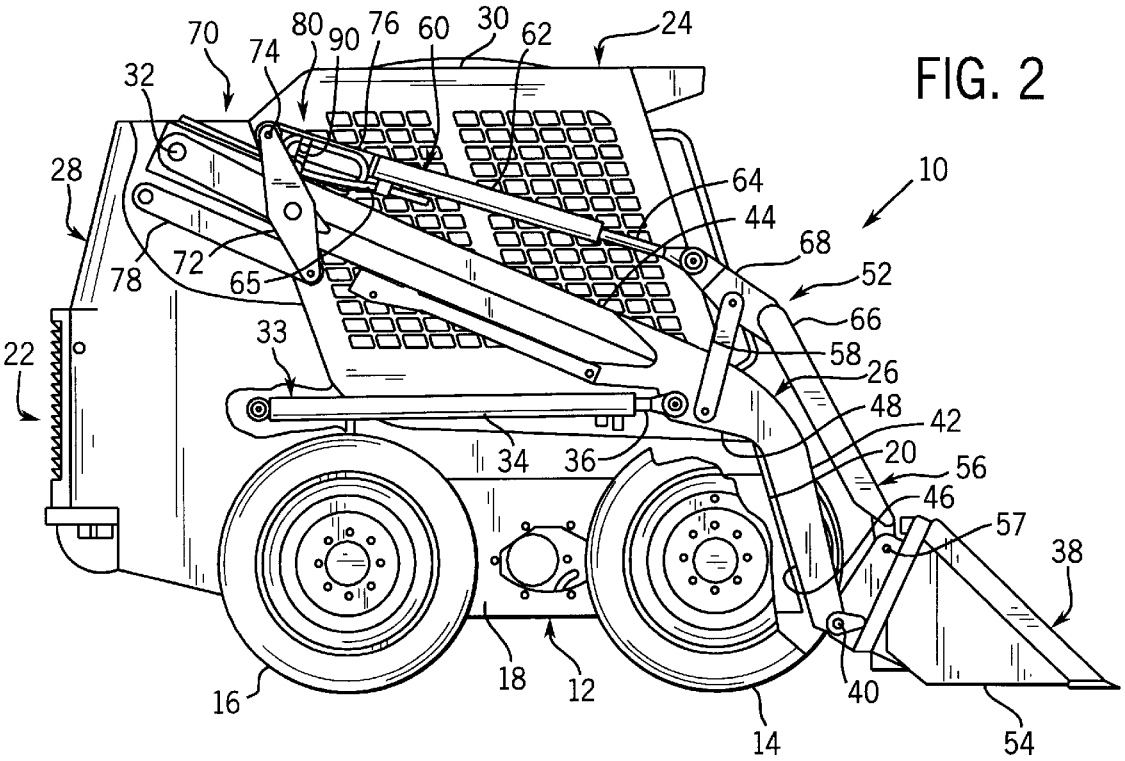
FIG. 2 is a side view of the loading vehicle in FIG. 1.
Figure 3:
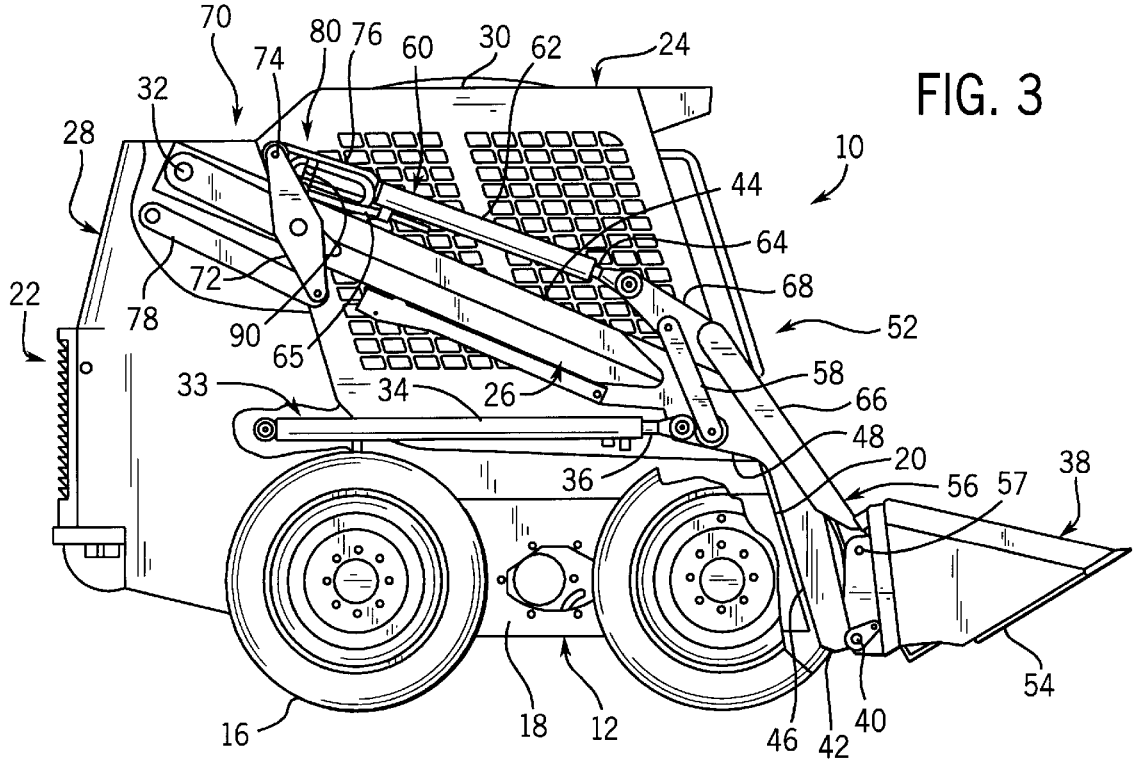
FIG. 3 is a side view of the loading vehicle showing the bucket retracted to a raised or rack-back position.

Referring now to the drawings, wherein like reference numerals refer to like parts throughout the several views, there is shown in FIG. 1 a skid steer loader 10 having an elongated body or frame 12 supported by two sets of wheels 14 and 16. The frame 12 includes spaced apart side walls 18 and a front end 20. An engine compartment 22 is located toward the rear of the frame 12, and an operator's cab 24 is located near the front of the frame 12. To support a pair of lift arms 26, a pair of transversely spaced stanchions or uprights 28 extend upwardly along opposite sides of the engine compartment 22 at the rear of the loader 10, and terminate at about the same height as a roof 30 of the cab 24. The uprights 28 are generally U-shaped and open toward the front to receive the corresponding lift arms 26. Each lift arm 26 is pivotally attached at a rear end thereof by a pivot pin 32 to the upper end of the corresponding upright 28. As illustrated in FIGS. 1–3, the lift arms 26 extend downwardly alongside the cab 24 and past the front end 20 of the frame 12. By pivotally mounting the lift arms 26 to the rear and top of the loader 10, the overall length of the loader is decreased, while increasing the maximum obtainable lift height and reach afforded by the lift arms 26.

Figure 4:
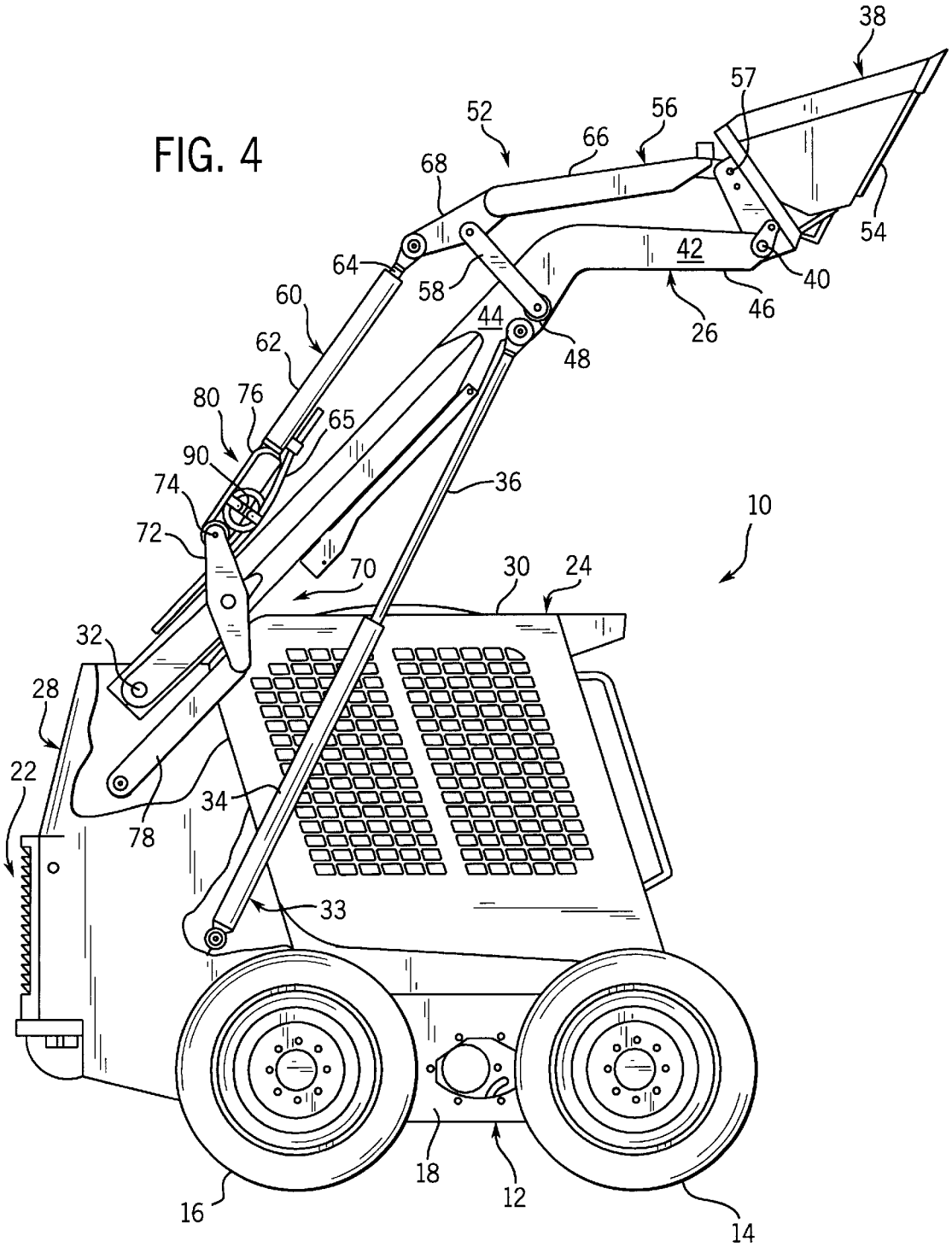
FIG. 4 is a side view of the loading vehicle showing the lift arms in a raised position and the bucket in generally the same rack-back position.

The lift arms 26 are adapted to be simultaneously raised and lowered relative to the frame 12 by respective fluid lift cylinder assemblies 33. Each lift cylinder assembly 33 underlies a corresponding lift arm 26 and includes a cylinder 34 pivotally attached to the frame 12 or upright 28 and a piston rod 36 pivotally attached to the lift arm 26. A work implement 38, such as a bucket or a lift fork, is pivotally connected to a forward end of the lift arms 26 by pivot pins 40. Thus, the work implement 38 is adapted to be raised and lowered by the lift arms 26 as shown in FIGS. 3 and 4 by extension and retraction of the cylinder assemblies 33.

To position the work implement as close as possible to the front end 20 of the loader 10, the lift arms 26 are bent to define a forward section 42 and a rearward section 44. Preferably, a lowermost edge 46 of the forward section 42 angles downwardly from a lowermost edge 48 of the rearward section 44 and generally follows the profile of the frame 20 around the front end thereof. Thus, the lift arms 26 avoid contact with the frame 12 when the lift arms 26 are in a lowered position, thereby placing the work implement adjacent the front end 20 of the frame 12. In addition, the lift arms 26 are horizontally spaced inboard from the front tires 14 to avoid interference with the front tires 14. To synchronize and stabilize operation of the lift arms 26, a horizontal cross-bar 50 interconnects the lift arms 26. As shown in FIG. 1, the cross-bar 50 is positioned generally adjacent the juncture of the forward sections 42 and rearward sections 44 of the lift arms 26. As a result, the cross-bar 50 avoids contact with the frame 12 when the lift arms 26 are in a lowered position to place the work implement 38 adjacent the front end 20 of the frame 12. As can be appreciated by the foregoing description, the maneuverability of the loader 10 is enhanced by placing the work implement 38 close to the frame 12 without changing the overall width or wheel base of the loader 10.

Figure 5:
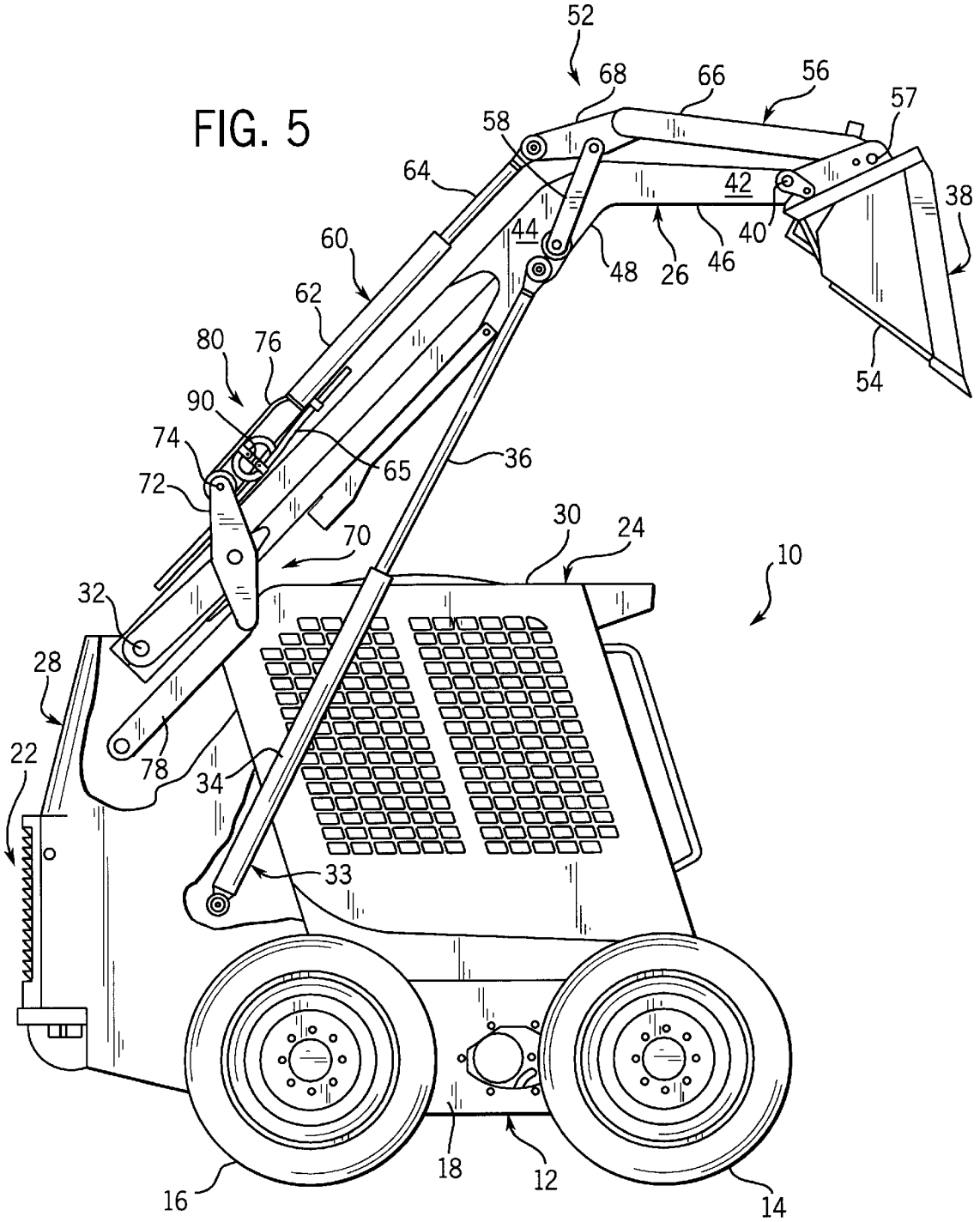
FIG. 5 is a side view of the loading vehicle showing the lift arms in a raised position and the bucket in a lower tilt or dump position.

In addition to the raising and lowering of the work implement 38 discussed above, a tilt mechanism 52 is provided for tilting the work implement 38 between an intermediate loading position (FIG. 2), a raised or "rack-back" position (FIG. 3), and a lowered or "dump" position (FIG. 5). In the intermediate position, an underside 54 of the bucket 38 is substantially horizontal at grade to load material thereon. In the raised or "rack-back" position, the underside 54 of the bucket 38 is tilted above a horizontal plane, preferably between about 30 degrees at ground level to about 55 degrees at full lift, to maintain materials therein. In the lowered or "dump" position, the underside 54 is tilted below the horizontal plane to dump material therefrom.

The tilt mechanism 52 includes a pair of tilt linkages 56 pivotally connected to the work implement 38 by pivot pins 57 at a location spaced from the pivotal attachment of the lift arms 26 at pivot pins 40. In addition, a pair of extension arms 58 pivotally interconnect the lift arms 26 and the tilt linkages 56, and a pair of fluid tilt cylinder assemblies 60 are pivotally connected to the tilt linkages 56. Each tilt cylinder assembly 60 overlies a corresponding lift arm 26 and includes a cylinder 62 pivotable relative to the frame 12, a piston rod 64 axially extendible from the cylinder 62 and having one end pivotally attached to the tilt linkage 56, and a pair of fluid conduits 65, 67 for supplying fluid to and bleeding fluid from the cylinder 62.

In a most preferred embodiment, the cylinder assemblies 60 are double-acting hydraulic cylinder assemblies wherein each of the fluid conduits 65 and 67 alternately functions as a supply line and a return or bleed line. In the illustrated embodiment shown in FIGS. 6–8, the fluid conduit 65 acts as a supply line and the fluid conduit 67 acts as a return or bleed line to cause the piston rod 64 to extend from the cylinder 62. To retract the piston rod 64, the function of the fluid conduits 65 and 67 is reversed, whereupon the fluid conduit 67 acts as a supply line and the fluid conduit 65 acts as a bleed line.

As is well known in the art, a controller (not shown) is provided in the cab region 24 of the off-highway loader 10 for controlling the supply of fluid to and from the tilt cylinders 60 via the fluid conduits 65 and 67. In response to manual manipulation thereof, the controller in the cab region 24 influences the position of a manually positionable valve (not shown) to control the flow of fluid between a pressurized source of fluid (not shown), such as a pump or the like carried on the frame 12 of the loader, and opposite ends of each tilt cylinder 62. In this regard, fluid conduits 65 and 67 are connected to and extend from opposite ends of each tilt cylinder 62.

Thus, the work implement 38 is adapted to be tilted by the tilt linkages 56 through operation of the controller and extension and retraction of the piston rods 64. Preferably, each tilt linkage 56 includes a rigidly interconnected forward section 66 and rearward section 68. The forward section 66 extends at an angle from the rearward section 68 to generally follow the bent profile of the corresponding lift arm 26. To avoid interference with the lift arms 26 when the lift arms 26 are in the lowered position and the work implement 38 is retracted to the rack back position shown in FIG. 3, the forward section 66 is laterally offset from the rearward section 68. In addition, the extension arms 58 are preferably connected to the rear sections 44 of the lift arms 26 and the rear sections 68 of the tilt linkages 56 to provide optimum load distribution.

It will be appreciated by those skilled in the art that the offset linkages 56 allow the entire tilt mechanism 52 to be generally aligned in a vertical plane with the corresponding lift arms 26, thereby providing an "in-line" linkage arrangement which enhances visibility to the work implement 38. Moreover, it will be appreciated that the extension arms 58 provide a moment arm through which the force of the tilt cylinder assemblies 60 are increased, thereby providing a generally uniform tilt capability over the entire range of tilt heights which can accommodate the maximum force required by any work implement. Thus, the in-line linkage arrangement generates bucket torque which continuously increases from full dump to full rack positions, and simultaneously decreases bucket speed continuously from full dump to full rack positions. As a result, the linkage arrangement provides fast dump speed with great power and control when grading or during breakout with the bucket.

A self-leveling mechanism 70 is also provided to maintain the work implement 38 in a generally constant angular position as it is raised by the lift arms 26. The self-leveling mechanism 70 includes a pair of levers 72 pivotally attached between the ends thereof to rear portions of the corresponding lift arms 26. An upper end of each lever 72 is pivotally attached to a rear end portion 76 of the corresponding tilt cylinder 60 at pivot points 74, thereby allowing movement of the tilt cylinder pivot point in response to raising and lowering of the lift arms 26. To anchor the levers 72 to the frame 12 and control the movement of the tilt cylinders 62, a pair of leveling linkages 78 are pivotally attached to the uprights 28 and the lower ends of the levers 72. Thus, the levers 72 pivot forwardly as the lift arms 26 are raised as shown in FIG. 4 to move the pivotal mounting of the tilt cylinders 62 and cause the cylinders 62 to move in a generally end-wise parallel relation relative to the lift arms 26. As a result, the work implement 38 is automatically tilted forwardly to compensate for rearward tilting which would normally occur when the lift arms 26 pivot to raise the work implement 38. This parallel lift advantage obviates the need for manual tilt adjustment of the work implement 38 during the lift cycle.

As will be appreciated, the fluid lines or conduits 65 and 67 each leading between the fixed valve in the loading vehicle 10 and the respective ends of the tilt cylinders 62 must be of sufficient length to allow for end-wise movement of the tilt cylinders 62 in response to operation of the self-leveling mechanism 70. That is, when the lift arms 26 are in a lowered elevational position as shown in FIG. 6, the length or distance from the valve controlling the tilt cylinders 62 to the location wherein the conduits or lines connect to the tilt cylinders is a first predetermined length. Whereas, when the lift arms 26 are raised and the self-leveling mechanism 70 operates to move the tilt cylinders generally forwardly as shown in FIG. 7, thereby maintaining the work implement 38 in a generally fixed disposition relative to the ground, the distance from the valve controlling the tilt cylinders assemblies 60 to the locations where the fluid lines or conduits 65 and 67 connect to the tilt cylinders 62 is a second predetermined length. As will be appreciated, the second predetermined length is necessarily greater than the first predetermined length. As a result, the lowering of the lift arms 26 and the rearward movement of the cylinders 62 creates a progressively greater excess length of the conduits 65 and 67, which normally tends to hang loose and perhaps get caught in the components of the linkage mechanism.

Accordingly, another aspect of the present invention is to provide a conduit control device 80 that compensates for the excess slack in the conduits resulting from end-wise rearward movement of the tilt cylinders 62. As will be described, the conduit control device 80 maintains the fluid lines or conduits 65 and 67 generally taut throughout the range of end-wise movement of the tilt cylinders 62 resulting from operation of the self-leveling mechanism 70. As shown in FIGS. 6 through 8, the control device 80 is preferably arranged toward a rear end portion of each tilt cylinder 62. In a most preferred form of the invention, the control device 80 includes a guide 82 that also serves to articulately interconnect the tilt cylinder 62 to the pivot point 74 of the respective lever 72 of the self-leveling mechanism 70. As shown in FIG. 8, the guide 82 has an elongated configuration with a generally T-shaped cross-section defining a pair of open cavities 84 and 86 disposed on opposite sides of a generally centralized depending web 88. The open cavities 84, 86 on each side of the guide 82 are configured to receive an expandable and contractible coiled loop portion 89 of the fluid lines or conduits 65, 67 leading to one end of the tilt cylinder 62.

To secure the fluid conduits 65 and 67 to the guide 82, a removable attachment member such as a clip 90 is mounted to the web 88 of the guide 82. The clip 90 is adapted to hold the conduits 65 and 67 in a loop orientation such that an upper coiling leg 92 of each loop portion 89 generally overlies a lower coiling leg 93. As illustrated in FIGS. 6 and 7, when the lift arms 26 are lowered and the pivot points 74 of the tilt cylinders 62 move rearwardly, the upper coiling leg 92 of the fluid conduits 65 and 67 progressively engage the cavities 84, 86 in the guide member 82, thereby remaining relatively generally taut.

Preferably, the clip 90 includes a pair of upper bands 96 for fixedly retaining the upper coiling legs 92 of the respective conduits 65, 67, and a pair of lower bands 98 for securely retaining the fixed legs 94 of the conduits 65, 67. To restrict the lower coiling legs 93 from moving laterally outwardly, and also to influence the upper coiling legs 92 toward the guide 82, the fixed legs 94 are positioned laterally outwardly from each lower coiling leg 93. Preferably, the spacing between the lower bands 98 is greater than the spacing between the upper bands 96 so that upper and lower coiling legs 92, 93 can remain in substantial alignment. As illustrated in FIG. 8, a bolt 99 is provided to laterally space the lower bands 98 the desired amount.

The operation of the foregoing preferred embodiment of the invention will now be discussed with reference to FIGS. 1–8. In FIGS. 1 and 2, the lift arms 26 are in the lowered position and the bucket 38 is placed close to the front end 20 of the loader 10. The bucket 38 is also in the horizontal intermediate position for loading material. Once material is scooped into the bucket 38, the piston rods 64 of the tilt cylinder assemblies 60 are retracted to move the linkages 56 and tilt the bucket 38 to the rack-back position (FIG. 3). As shown in FIG. 3, the offset forward sections 66 of the tilt linkages 56 allows the forward sections to pass by the lift arms 26 without interference. To raise the bucket 38 a desired amount for dumping of the material, the piston rods 36 of the lift cylinder assemblies 33 are extended as shown in FIG. 4, thereby raising the lift arms 26. At the same time, the levers 72 automatically pivot forwardly to move the pivot points 74 of the tilt cylinder assemblies 60 forwardly, thus maintaining the same general "rack-back" attitude of the bucket 38. Also, a certain amount of slack in the fluid conduits 65, 67 is taken up by the movement of the tilt cylinders 60, yet controlled by the conduit control device 80. When an operator arrives at the desired location for the material in the bucket 38, the piston rods 64 of the tilt cylinder assemblies 60 are extended to tilt the bucket 38 forwardly to the dump position in which material falls out of the bucket 38.

Thus, a loading vehicle is provided with enhanced overall maneuverability, improved visibility to the work implement, and advanced loading characteristics.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An off-highway loading vehicle having a frame, a cab, front and rear tires, and a linkage arrangement for operably attaching a work implement to the frame, comprising:

a pair of spaced apart lift arms having a rear end portion pivotally connected to the frame and a forward end portion pivotally connected to the work implement, a lowermost edge of a forward section of the lift arms angling downwardly from a lowermost edge of a rearward section thereof, whereby the lift arms avoid contact with the frame when in a lowered position to place the work implement adjacent a front end of the frame;

a lifting device acting between the frame and the lift arms to move the lift arms between said lowered position and a raised position; and a tilt mechanism to pivot the work implement between a lowered position in which an underside thereof is tilted below a horizontal plane, an intermediate position in which said underside is substantially horizontal, and a raised position in which said underside is tilted above the horizontal plane, said tilt mechanism including a pair of tilt linkages pivotally connected to said work implement wherein the tilt linkages are generally aligned in respective vertical planes with the corresponding lift arms, each tilt linkage having an offset portion to avoid interference with the corresponding lift arm when the work implement is retracted by the tilt mechanism to the raised position with the lift arms in the lowered position, a pair of extension arms interconnecting the lift arms and the tilt linkages, and a pair of tilt cylinders operatively connected between the lift arms and the pair of tilt linkages to thereby tilt the work implement a desired amount, said tilt cylinders pivoting with respect to the frame in response to raising and lowering of the lift arms.

2. The loading vehicle of claim 1 wherein the tilt cylinders are pivotally connected to respective rear end portions of said pair of tilt linkages.

3. The loading vehicle of claim 1 further comprising a self-leveling mechanism adapted to maintain the work implement in a generally constant angular position as said work implement is raised by the lift arms, said self-leveling mechanism comprising each of said tilt cylinders having a rear end pivotally attached to an upper end of a lever, said levers being pivotally attached intermediate opposing ends thereof to the lift arms, and having a lower end pivotally attached to a pair of pivot arms which are connected to the frame.

4. The loading vehicle of claim 1 wherein the rear end portions of the lift arms are connected to the frame rearwardly of the forward cab.

5. The loading vehicle of claim 4 wherein the rear end portions of the lift arms are connected to the frame at a level generally as high as a top portion of the cab.

6. The loading vehicle of claim 1 wherein the lift arms are horizontally spaced inboard of the front tires to avoid interference therewith, and the lift arms angle downwardly to avoid interference with a forward portion of the frame.

7. The loading vehicle of claim 1 further comprising a horizontal cross-bar interconnecting the lift arms, said cross-bar being positioned generally adjacent the juncture of said forward section and rearward section of said lift arms, whereby the cross-bar is positioned to avoid contact with the frame when the lift arms are in a lowered position to place the work implement adjacent a front end of the frame.

8. An off-highway loading vehicle having a frame, a cab, front and rear tires, and a linkage arrangement for operably attaching a work implement to the frame, comprising:

a pair of spaced apart lift arms having a rear end portion pivotally connected to the frame rearwardly of the cab and a forward end portion pivotally connected to the work implement, a lowermost edge of a forward section of the lift arms angling downwardly from a lowermost edge of a rearward section thereof, whereby the lift arms avoid contact with the frame when in a lowered position to place the work implement adjacent a front end of the frame;

a pair of lift cylinders pivotally attached to the frame and the lift arms to move the lift arms between said lowered position and a raised position; and a tilt mechanism to pivot the work implement between a lowered position in which an underside thereof is tilted below a horizontal plane, an intermediate position in which said underside is substantially horizontal, and a raised position in which said underside is tilted above the horizontal plane, said tilt mechanism including a pair of tilt linkages pivotally connected to said work implement, a pair of extension arms interconnecting the lift arms and the tilt linkages, the extension arms being pivotally connected to the rearward sections of the lift arms, and a pair of tilt cylinders having forward ends pivotally connected between the lift arms and said tilt linkages to thereby tilt the work implement a desired amount.

9. The loading vehicle of claim 8 wherein the tilt linkages, tilt cylinders and extension arms are generally aligned in respective vertical planes with the corresponding lift arms, and each tilt linkage has an offset portion displaced from said respective vertical plane to avoid interference with said lift arms when the work implement is retracted by the tilt mechanism to the raised position with the lift arms in the lowered position.

10. The loading vehicle of claim 8 wherein the rear end portions of the lift arms are connected to the frame at a level generally as high as a top portion of the cab.

11. The loading vehicle of claim 8 wherein the lift arms are horizontally spaced inboard from the front tires to avoid interference therewith, and the lift arms angle downwardly to avoid interference with a forward portion of the frame.

12. The loading vehicle of claim 8 further comprising a horizontal cross-bar interconnecting the lift arms, said cross-bar being positioned generally adjacent the juncture of said forward section and rearward section of said lift arms, whereby the cross-bar is positioned to avoid contact with the frame when the lift arms are in a lowered position to place the work implement adjacent a front end of the frame.

13. An off-highway loading vehicle having a frame, a forward cab, front and rear tires, and a linkage arrangement for operably attaching a work implement to the frame, comprising:

a pair of spaced apart lift arms having a rear end portion pivotally connected to the frame rearwardly of the cab at a level generally as high as a top portion of the cab, and a forward end portion pivotally connected to the work implement, a lowermost edge of a forward section of the lift arms angling downwardly from a lowermost edge of a rearward section thereof, whereby the lift arms avoid contact with the frame when in a lowered position to place the work implement adjacent a front end of the frame;

a horizontal cross-bar interconnecting the lift arms, said cross-bar being positioned generally adjacent the juncture of said forward section and rearward section of said lift arms, whereby the cross-bar is positioned to avoid contact with the frame when the lift arms are in a lowered position to place the work implement adjacent a front end of the frame;

a pair of lift cylinders pivotally attached to the frame and the lift arms to move the lift arms between said lowered position and a raised position;

a self-leveling mechanism adapted to maintain the work implement in a generally constant angular position, said self-leveling mechanism including a pair of levers pivotally attached to rear portions of said lift arms, and a pair of leveling linkages pivotally attached to the frame and lower ends of the levers; and a tilt mechanism to pivot the work implement between a lowered position in which an underside thereof is tilted below a horizontal plane, an intermediate position in which said underside is substantially horizontal, and a raised position in which said underside is tilted above the horizontal plane, said tilt mechanism including a pair of tilt linkages pivotally connected to said work implement, a pair of extension arms pivotally interconnecting the lift arms and said tilt linkages, and a pair of tilt cylinders having forward ends pivotally connected to said tilt linkages and rearward ends pivotally connected to upper ends of the levers, said tilt linkages being aligned in respective generally vertical planes with the corresponding lift arms, and each tilt linkage having an offset portion displaced from said respective vertical plane to avoid interference with said corresponding lift arm when the work implement is retracted by the tilt mechanism to the raised position with the lift arms in the lowered position.

14. The loading vehicle of claim 13 wherein the lift arms are horizontally spaced inboard from the front tires to avoid interference therewith, and the lift arms angle downwardly to avoid interference with a forward portion of the frame.

15. The loading vehicle of claim 13 wherein the extension arms are pivotally connected to the rearward sections of the lift arms.

16. An apparatus for maintaining a fluid conduit generally taut during operation of a linkage arrangement adapted to operably raise and tilt a work implement relative to a frame of an off-highway loading vehicle, the apparatus in combination with the fluid conduit and linkage arrangement comprising:

a lift arm having a rear end portion pivotally connectable to the frame and a forward end portion pivotally connectable to the work implement;

a lifting device operatively connectable between the frame and the lift arm to move the lift arm between a lowered position and a raised position;

a tilt mechanism including a tilt cylinder assembly supported on the lift arm and operatively connectable to tilt the work implement, said tilt cylinder assembly being pivotable about a moveable pivot point and having the fluid conduit attached thereto;

a self-leveling mechanism operatively connected to the lift arm and supporting the pivot point of the tilt cylinder assembly so as to move said pivot point in response to movement of the lift arm, thereby maintaining the work implement in a generally constant angular position as said work implement is moved by the lift arm; and a conduit control device provided on the tilt mechanism to hold the fluid conduit in a loop orientation so as to retain the fluid conduit generally taut throughout the range of movement of the tilt cylinder assembly pivot point.

17. The apparatus of claim 16 wherein the conduit control device includes an attachment member to secure the fluid conduit to a rear end portion of said tilt cylinder assembly and a guide member to guide the fluid conduit proximate the rear end portion of the tilt cylinder assembly, said fluid conduit progressively engaging the guide member as the length of fluid conduit increases during movement of the lift arm.

18. The apparatus of claim 17 wherein the guide member includes a cavity formed on a rear end portion of the tilt cylinder assembly to receive the fluid conduit in progressive fashion.

19. The apparatus of claim 18 wherein the attachment member includes a clip mounted on the tilt cylinder assembly to hold the fluid conduit in the loop orientation such that a coiling portion of the loop generally overlies a fixed portion of the loop, said coiling portion of the loop progressively engaging the cavity in the guide member during lowering of the lift arm.

20. The apparatus of claim 17 wherein a pair of fluid conduits are attached to the tilt cylinder assembly, the guide member has an elongated configuration with a generally T-shaped cross-section defining a pair of open cavities disposed on opposite sides of a generally centralized depending web to receive the pair of conduits, said attachment member being mounted to the web and adapted to hold the pair of conduits in said loop orientation.

21. A loading mechanism for an off-highway loading vehicle having a frame, a cab, front and rear tires, and a linkage arrangement for operably attaching a work implement to the frame, comprising:

a pair of spaced apart lift arms having a rear end portion pivotally connectable to the frame and a forward end portion pivotally connectable to the work implement;

a lifting device operatively connectable between the frame and the lift arms to move the lift arms between a lowered position and a raised position;

a tilt mechanism including a tilt cylinder assembly supported on each lift arm and operatively connectable to tilt the work implement, each tilt cylinder assembly being pivotable about a moveable pivot point and having a fluid conduit attached thereto;

a self-leveling mechanism operatively connected to each tilt mechanism so as to move the corresponding pivot points in response to movement of the lift arms, thereby maintaining the work implement in a generally constant angular position as said work implement is moved by the lift arms; and a conduit control device provided on each tilt cylinder assembly to retain the respective fluid conduit generally taut throughout the range of movement of the tilt cylinder assembly pivot points, each control device including an attachment member to secure the respective fluid conduit in a loop orientation to a rear end portion of the corresponding tilt cylinder assembly, and a guide member proximate the rear end portion of the corresponding tilt cylinder assembly to guide the fluid conduit, said fluid conduits progressively engaging the respective guide members as the length of fluid conduits increase during movement of the lift arms.

22. The loading mechanism of claim 21 wherein a pair of fluid conduits are attached to each tilt cylinder assembly, the guide member has an elongated configuration with a generally T-shaped cross-section defining a pair of open cavities disposed on opposite sides of a generally centralized depending web for receiving the pair of conduits.

23. The loading mechanism of claim 22 wherein each attachment member comprises a clip mounted to the web and adapted to hold the fluid conduits in the loop orientation such that a coiling portion of the fluid conduits generally overlies a fixed portion of the fluid conduits, said coiling portions of the fluid conduits progressively engaging the associated cavities in the guide members during movement of the lift arms.

24. The loading vehicle of claim 8 further comprising a self-leveling mechanism adapted to maintain the work implement in a generally constant angular position as said work implement is raised by the lift arms, said self-leveling mechanism including a rear end of each of said tilt cylinders being pivotally attached to an upper end of a lever, each of said levers being pivotally attached at an intermediate point thereof to the respective lift arm and having a lower end pivotally attached to a respective pivot arm connected to the frame.

* * * * *